US005310325A

United States Patent [19]

Gulyash

[11] Patent Number: 5,310,325

[45] Date of Patent: May 10, 1994

[54] ROTARY ENGINE WITH ECCENTRIC GEARING

[76] Inventor: Steve I. Gulyash, 3071 Burnhamthorpe Road, Oakville, Ontario, Canada, L6J 4Z3

[21] Appl. No.: 39,673

[22] Filed: Mar. 30, 1993

[51] Int. Cl.[5] ..... F01C 1/063

[52] U.S. Cl. ..... 418/61.2; 123/242; 475/177

[58] Field of Search ..... 418/61.2, 61.1; 123/242; 475/162, 176, 177

[56] References Cited

U.S. PATENT DOCUMENTS

| | | | |
|---|---|---|---|
| 3,744,941 | 7/1973 | Nestor | 418/61.2 |
| 3,875,905 | 4/1975 | Duquette | 418/61.2 |
| 4,132,513 | 1/1979 | Kulina | 418/60 |
| 4,137,024 | 1/1979 | Jones | 418/61 A |
| 4,150,926 | 4/1979 | Eiermann | 418/61 A |
| 4,389,172 | 6/1983 | Griffith | 418/61 A |
| 4,487,561 | 12/1984 | Eiermann | 418/61 A |
| 4,915,071 | 4/1990 | Hansen | 123/242 |
| 5,067,883 | 11/1991 | Adiwanata | 418/61.2 |

*Primary Examiner*—Richard A. Bertsch
*Assistant Examiner*—Charles G. Freay

[57] ABSTRACT

A rotary engine having a three apex rotor rotatably and eccentrically mounted on a driven shaft. The rotor having a central internal ring gear meshing with an eccentrically mounted pinion gear. The pinion gear drives the driven shaft with a 1:1 ratio and the eccentricities of the rotor and the pinion gear are of equal magnitude and direction so that the gears stay in contact. The eccentricity of the gears is not fixed with respect to the size of the gears. The pinion gear is fixed on a shaft spaced from the driven shaft and supports the ring gear and the rotor as it is driven by the rotor.

20 Claims, 4 Drawing Sheets

ROTARY ENGINE WITH ECCENTRIC GEARING

FIELD OF THE INVENTION

This invention relates to rotary engines and in particular to a rotary engine having a three apex rotor which rotates in an epitrochoidal housing.

Rotary engines are an alternative to the more common piston engine and theoretically provide advantage in weight per unit of power output. Rotary engines can run on most combustible fuels, such as gasoline, diesel or hydrogen and can be used in land, sea or air vehicles.

This invention pertains to the type of rotary engine having a rotor which is turned in a housing and sweeps a volume of fuel through the stages of intake, combustion and exhaust. Examples of this type of rotary engine are found in U.S. Pat. Nos. 4,150,926, 4,389,172, 4,487,561 and 5,067,883. The invention will be described with respect to a rotary engine having a rotor with three apexes, positioned at an angle of 120 degrees to one another. The engine has gears to transmit power to a transmission or the like and to guide the rotor in a housing having a dual-lobed epitrochoidal shape. There are however applications of the invention in rotary engines having rotors with two or more apexes. The corresponding shape of the housing for a particular rotor can be determined from geometry and is well-known in the art.

DESCRIPTION OF THE PRIOR ART

There has generally been a problem in sealing the combustion chambers between the moving rotor and the relatively stationary housing. The rotor and the housing must be sealed in two places; the first is along the apex of the rotor as it follows the epitrochoidal shape of a side wall of the housing. The second place requiring sealing is between the edges of the rotor and the front and back faces of the housing. Without proper sealing of the chambers, blow-by and poor compression will be present in the engine. Prior art rotary engines have attempted to solve this problem by providing, for example, seals of different materials, spring-loaded and fluid pressure-actuated construction. An example of an improved seal can be found in U.S. Pat. No. 4,137,024 disclosing a spring-loaded seal.

While it is important to provide new solutions for a better seal, it is also imperative to provide a rotary engine which exhibits as little force as possible on the seals throughout its use. A common problem with prior art rotary engines is that at the characteristically high engine speeds and forces, the gears transmitting the power and the bearings supporting rotation tend to wear, which introduces lateral or rotational play between the rotor and the housing. A main cause of early wear in a rotary engine is that the rotor is rotated eccentrically in the housing. This causes unbalanced forces acting on the bearings holding the rotor which promotes rotor wobble and gear wear. Attempts to minimize the effects of the eccentric rotation have led to providing counterbalances along the driveshaft of the engine. An example is shown in U.S. Pat. No. 4,132,513.

The eccentricity of the rotor is normally determined by the gearing ratio between an internal ring gear centrally mounted on one side of the rotor and a central gear mounted on the driveshaft extending coaxially through the housing. The ring gear and the rotor rotate eccentrically around the central gear. Particularly for a rotary engine with a three apex rotor, the gearing ratio between the ring gear and the central gear is conventionally 3:2. This will yield the proper rotation of the rotor so that its apexes follow the side wall of the epitrochoidal housing. The eccentricity of the rotor, fixed relative to the gear size, can be determined to be one quarter the diameter of the pinion gear. Therefore, the eccentricity of the rotor will increase for engines having a larger pinion gear and ring gear. It is desirable to be able to keep the eccentricity of the rotor at a minimum to reduce unbalanced forces even when using a large ring gear which has improved strength and wear characteristics.

SUMMARY OF THE INVENTION

It is among the objects of the invention to provide an improved rotary engine.

Accordingly, in one of its aspects, the invention provides a rotary engine comprising:

a housing having two opposing internal faces and a side wall joining said faces;

a driven shaft having an axis of rotation orthogonally extending substantially through the center of at least one of said opposing internal faces, the driven shaft having a lobe portion eccentric to said axis and located in the housing;

a rotor rotatably mounted on said lobe portion and having an internal ring gear substantially co-axial with said lobe portion;

a pinion gear meshing with the ring gear and eccentrically fixed on a pinion shaft, the pinion gear having the same eccentricity as said lobe portion, the pinion shaft extending orthogonally through one of said opposing internal faces of the housing and being rotatable therein; and drive means for transmitting torque between said pinion shaft and the driven shaft so that as the rotor is turned, the rotor substantially follows said side wall of the housing.

An advantage of the invention is that the eccentricity of the rotor is not dependent on the gear size. This is because the pinion gear is offset from the axis of rotation of the rotor and rotates eccentrically with the rotor. Thus, the eccentricity of the rotor can be reduced, thereby reducing unbalanced forces in the engine and minimizing the weight of counterbalance requirements.

Another advantage of the invention is that the force on the meshing gear teeth during combustion is reduced for a given diameter pinion gear. This is a result of the eccentricity of the pinion gear which provides a greater distance or moment arm from the center of the pinion shaft to the meshing gear teeth during combustion than if the pinion gear were centered on the shaft. Thus for a given torque output, the force on the meshing gear teeth is reduced.

BRIEF DESCRIPTION OF THE DRAWINGS

The invention will be more fully understood with reference to the following drawings, in which.

DESCRIPTION OF THE PREFERRED EMBODIMENT

Figure 1:
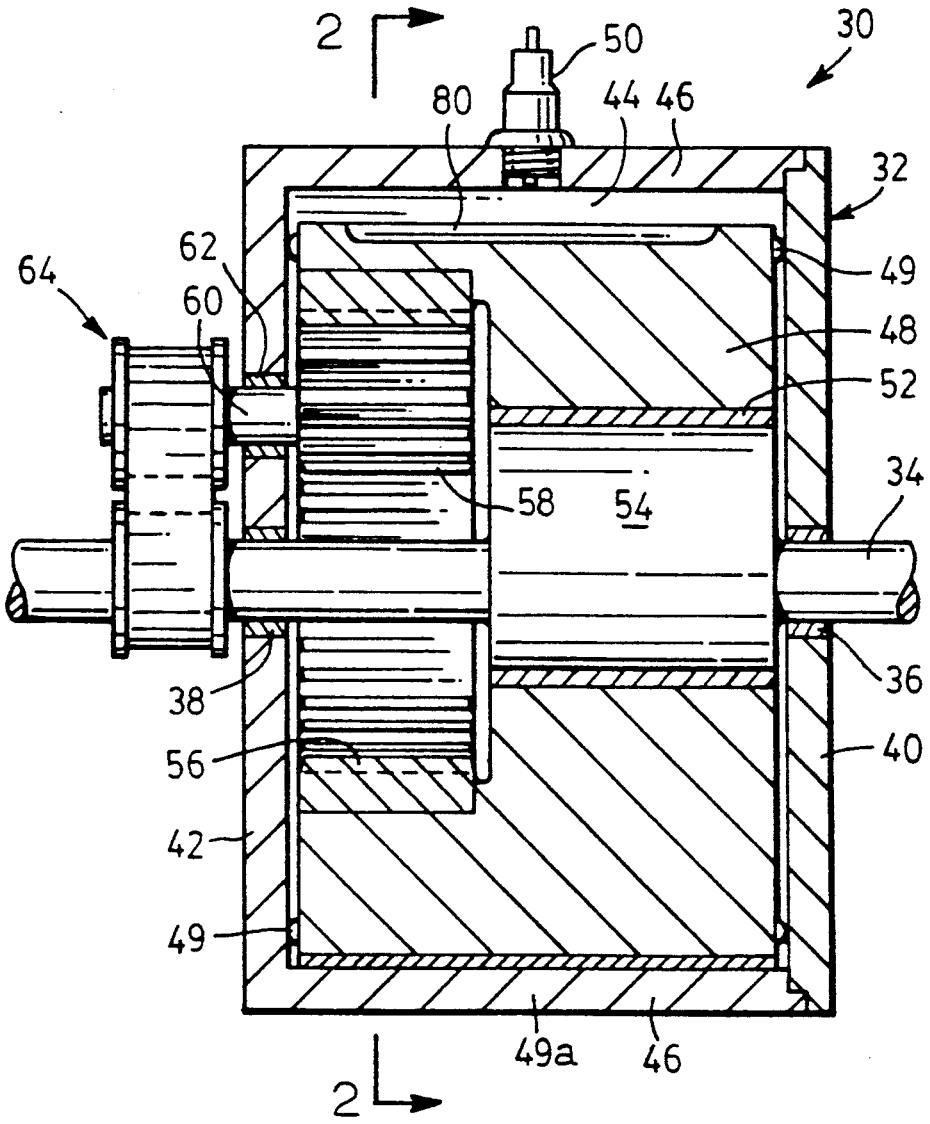
FIG. 1 is a partially sectional side view of a rotary engine according to a preferred embodiment of the invention.

Referring firstly to FIG. 1, a rotary engine 30 according to the invention is depicted. A sealed housing 32 covers and supports the working parts of the rotary engine 30. A driven shaft 34 extends orthogonally through the housing 32 and is supported by bearings 36, 38 in opposing internal faces 40, 42 of the housing 32. The driven shaft 34 would be coupled to a transmission or the like to drive a machine such as an automobile, motorcycle, or lawnmower, boat or airplane.

Various fuels could be used but the most common would be a mixture of gasoline and air. The mixture is inspired by the engine to enter a compression chamber 44 formed between a side wall 46 of the housing 32 and a rotor 48. The chamber 44 is sealed by side seals 49. An apex seal 49*a* is provided on each apex of the rotor 48 to complete the sealing of the chambers. At an appropriate time, the fuel is ignited by a spark plug 50. The combustion of the fuel causes the rotor 48 to rotate on bearing ring 52 about a lobe 54 which is fixed eccentrically to the driven shaft 34. As the rotor 48 rotates, a centrally mounted internal ring gear 56 (better shown in FIG. 2) meshes with and turns a pinion gear 58. The pinion gear 58 is eccentrically fixed on a pinion shaft 60 which extends orthogonally through the face 42 of the housing 32 and is supported in bearings 62. On the outside of the housing 32, the end of the pinion shaft 60 is coupled with the driven shaft 34 by a toothed belt drive 64 or a gear drive or other positive drive in a 1:1 ratio so that the pinion gear 58 will turn once for every turn of the eccentric lobe 54.

The force of combustion on the rotor 48 is supported along the width of the rotor 48 by the pinion gear 58 and the eccentric lobe 54. These in turn are supported by their respective shaft bearings 62, 36, 38 in the housing 32.

It should be noted that the eccentricities of the pinion gear and the lobe 54 are equal which means they are in the same direction and of the same magnitude. Therefore, as the pinion gear 58 is driven, its eccentric motion is matched by the eccentric motion of the lobe 54. This keeps the ring gear 56 meshed with the pinion gear 58. With the driven shaft 34 centered in the housing 32, the geometry of the gears when at a 1:3 ratio dictates that the eccentricity of the pinion gear 58 must be smaller than the radius of the pinion gear 58 less the radius of the driven shaft 34 in order for the pinion gear 58 to clear the driven shaft 34 as it rotates.

Reference is now made to FIGS. 2–5 which will be used to explain the various positions of the rotor during the use of the rotary engine.

Figure 2:
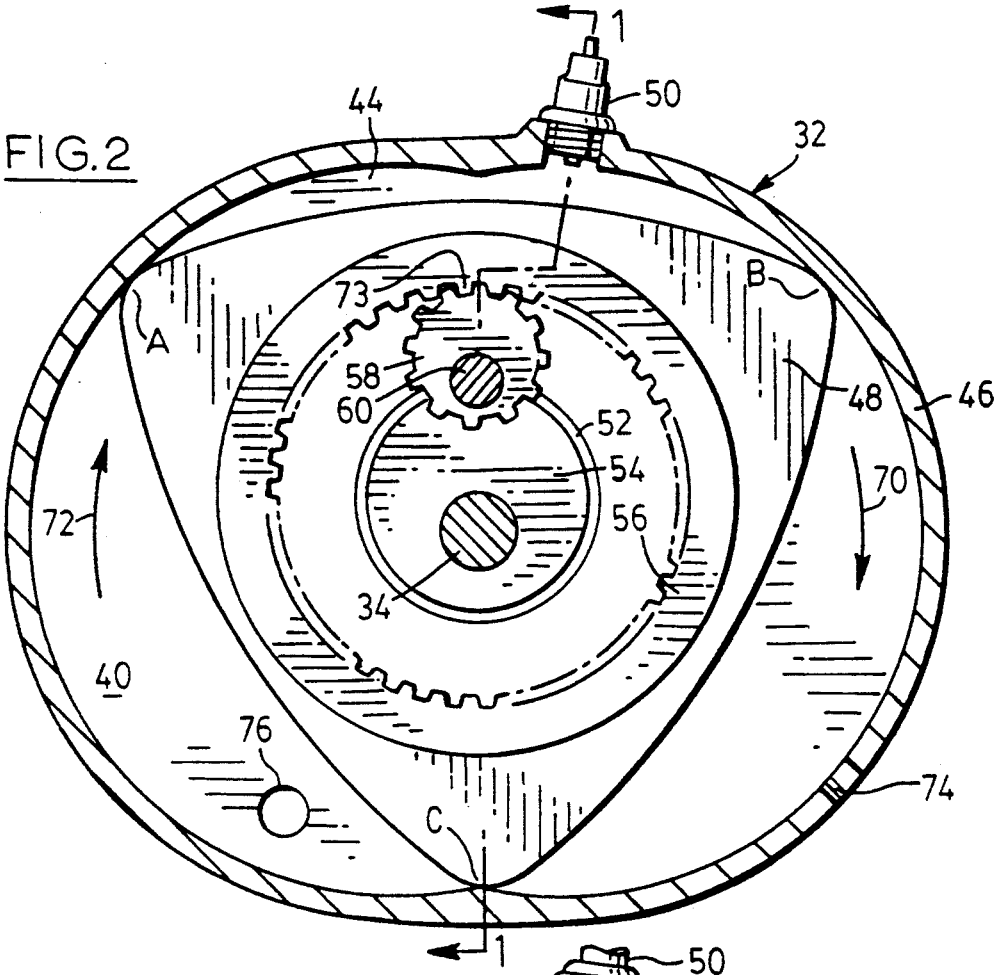
FIG. 2 is a schematic sectional view on line 2—2 of FIG. 1 showing a rotor of the rotary engine in a first position.

FIG. 2 shows the rotor 48 having three apexes A, B and C. As the rotor 48 turns, it is moved downwards and to the right by the eccentricity of the lobe 54 and pinion gear 48 and at the same time, the rotor 48 is being rotated by the pinion gear 58 so that the apexes A, B and C follow the side wall 46 which is of a dual-lobed epitrochoidal shape. The chamber 44 contains the compressed combustible fuel mixture (compression will be described later). The rotor is initially turned by a device such as a starter motor or a pull cord until, as the rotor 48 turns clockwise, the spark plug 50 ignites the mixture in chamber 44 causing an explosion which forces the rotor 48 to turn on the bearing ring 52 in a clockwise direction following arrows 70 and 72. It can be seen in FIG. 1 that the distance from the center of the pinion shaft 60 to the point where the pinion gear 58 meshes with the ring gear 56 is at a maximum. This provides a larger moment arm and the force on the meshing teeth 73 is less for a given torque.

Figure 3:
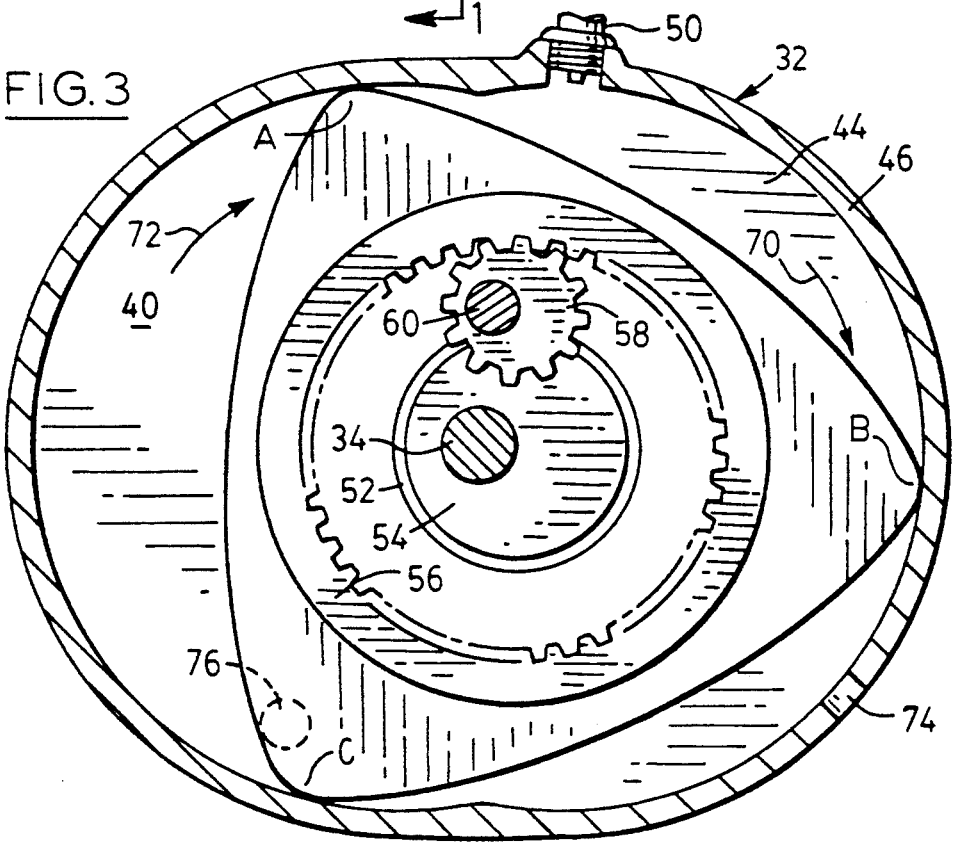
FIG. 3 is a view similar to FIG. 2 wherein the rotor has turned 30 degrees.

FIG. 3 shows the rotor 48 turned 30 degrees clockwise from the FIG. 2 position and the volume of chamber 44 has increased because of the geometry of the rotor 48 and the housing 32. It should be noted that the ratio of the pinion gear 58 to the ring gear 56 is 1:3, therefore, it can be seen that as the rotor 48 has turned 30 degrees, the pinion gear 58 has turned 90 degrees. The eccentric lobe 54, joined with a 1:1 ratio to the pinion gear 58, also turns 90 degrees. This keeps the pinion gear 58 synchronized with the ring gear 56 and moves the rotor 48 so that the apexes A, B and C continue to follow the side wall 46 of the housing 32. The pinion gear 58 and ring gear 56 will mesh at all positions of the rotor 48 because there is no relative movement between the centers of their rotation.

Figure 4:
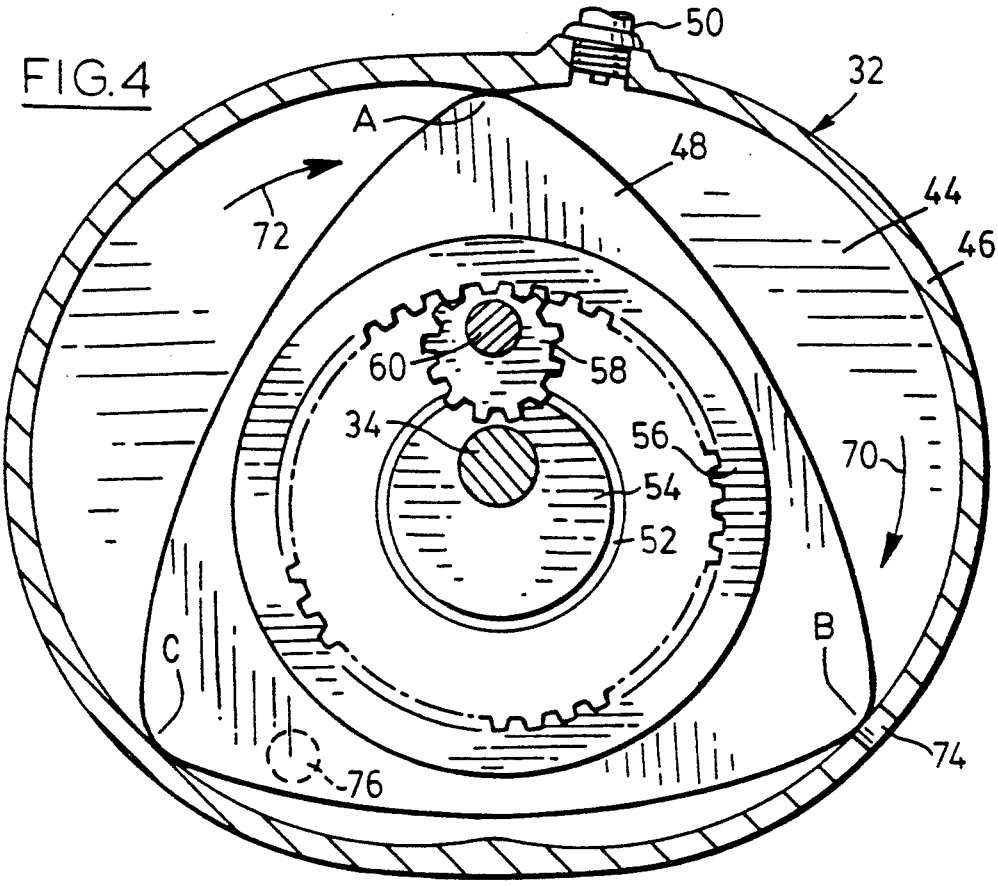
FIG. 4 is a view similar to FIG. 2 wherein the rotor has turned 60 degrees from the position shown in FIG. 2.

In FIG. 4, the rotor 48 has turned 60 degrees from the FIG. 2 position and the pinion 58 and lobe 54 have turned 180 degrees. At this point, the combusted mixture in chamber 44 is about to exhaust through exhaust port 74. The rotor then moves on to the FIG. 5 position where it has turned a total of 90 degrees from the FIG. 2 position and the pinion gear 58 and lobe 54 turned through 270 degrees. The spent fuel mixture in chamber 44 is exhausting through port 74.

Returning to FIG. 2, further exhausting of the combusted fuel can be seen, looking at the chamber between apexes B and C. It can be seen that the exhaust in the chamber is being swept by the rotor 48 through the exhaust port 74 by a reducing volume in the chamber. Further reduction of the volume between the apexes B and C is shown in FIG. 3. In FIG. 4, the volume of the chamber between apexes B and C is at a minimum and this is where the exhaust port 74 is closed to this chamber. Therefore, most of the spent fuel mixture has been exhausted through port 74.

Figure 5:
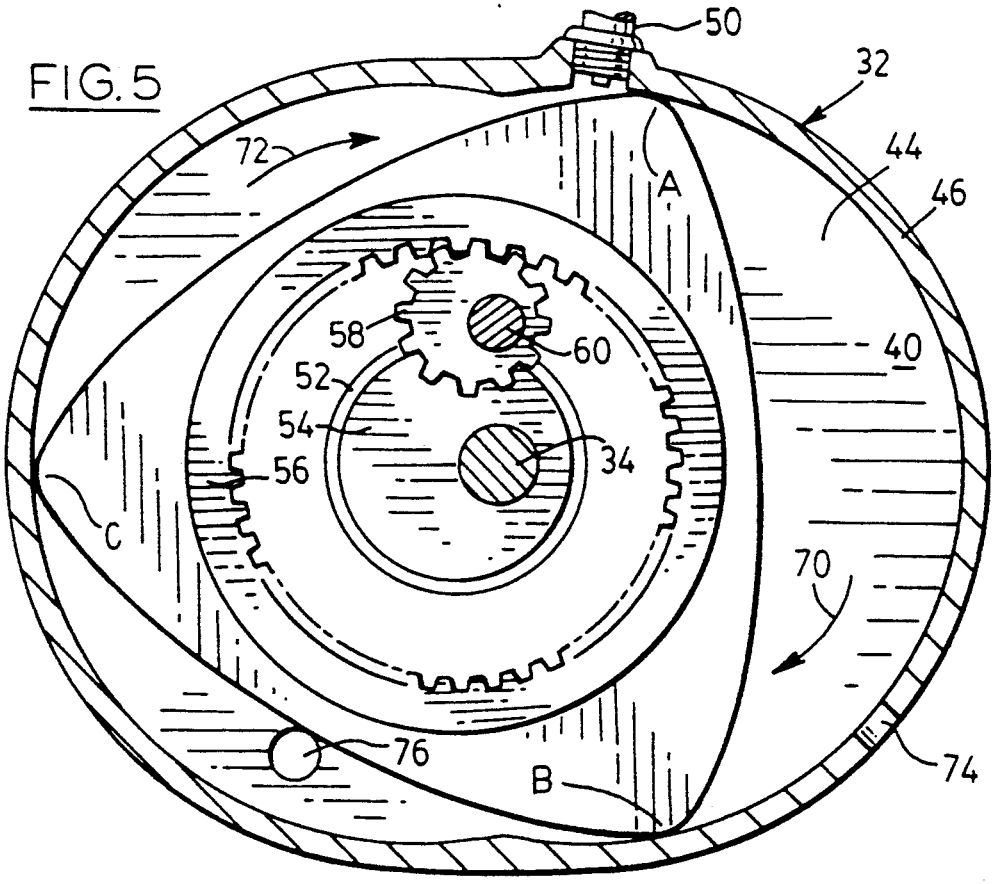
FIG. 5 is a view similar to FIG. 2 wherein the rotor has turned 90 degrees from the position shown in FIG. 2.

Intake of the fuel into the chamber between apexes B and C begins when the volume of the chamber is at a minimum, as shown in FIG. 4. A fuel intake port 76 can be seen in dashed line and is about to be uncovered as the rotor 48 is turned. In FIG. 5, the intake port 76 is revealed and the increasing volume of the chamber aids in sucking in the fuel. In FIG. 2, this intake is shown in the chamber between apexes A and C. The volume of the chamber continues to increase until, as illustrated in FIG. 3, the chamber volume is at a maximum and the intake port 76 is closed. From this point on, as the rotor is turned, the volume in the chamber will decrease and compress the fuel as shown in FIGS. 4–5. Finally, the rotor is turned to a position as shown in FIG. 2, where the fuel is compressed fully in chamber 44. The exhaust port 74 and intake port 76 have been positioned for simplicity of description. By providing a spring-loaded divider (not shown) where the lobes of the epitrochoidal meet at the bottom of the housing 32, minimum volumes of the chambers can be reduced so that the exhaust port is on the right of the divider and the intake port is on the left of the divider. This arrangement is well known in the art.

Overall, the three apex rotor 48 creates three chambers, all of which go through the stages of fuel intake, compression, combustion, and exhaust as the rotor 48 is rotated through 360 degrees. When the rotor 48 makes one revolution, the pinion gear 58 rotates three times, thus driving the driven shaft 34 to make three revolutions. For each combustion, the driven shaft 34 is turned one revolution.

The size of the rotary engine can be determined from the maximum volume of the intake chamber. This is the volume in the chamber between apexes A and C shown in FIG. 3. At this point, the eccentricity of the rotor 48 and the lobe 54 positions the rotor 48 to the extreme right of the engine 30. This volume would be multiplied by three for the three chambers per revolution of the rotor, to give the capacity of the engine which dictates the horsepower.

The compression ratio is the ratio between the aforementioned maximum volume and the volume of the chamber 44 as drawn in FIG. 2. A typical maximum volume for a chamber would be in the range of approximately 30 cubic centimeters (1.8 cubic inches) to approximately 500 cubic centimeters (30 cubic inches). The volume will depend on the height of the side wall 46, the curve of the rotor 48, and the shape of the housing 32. An engine with a maximum volume of 50 cubic centimeters (3 cubic inches) has been found to operate adequately. Likewise, an engine with a maximum volume of 80 cubic centimeters (4.9 cubic inches) operates adequately. Compression ratios may vary as desired, average compression ratio would be approximately 6:1 and a suitable range is from about 3:1 to about 12:1. The compression ratio and volumes can be altered by providing cavities formed in the sides of the rotor in a conventional manner such as, cavity 80, shown in FIG. 1.

Figure 6:
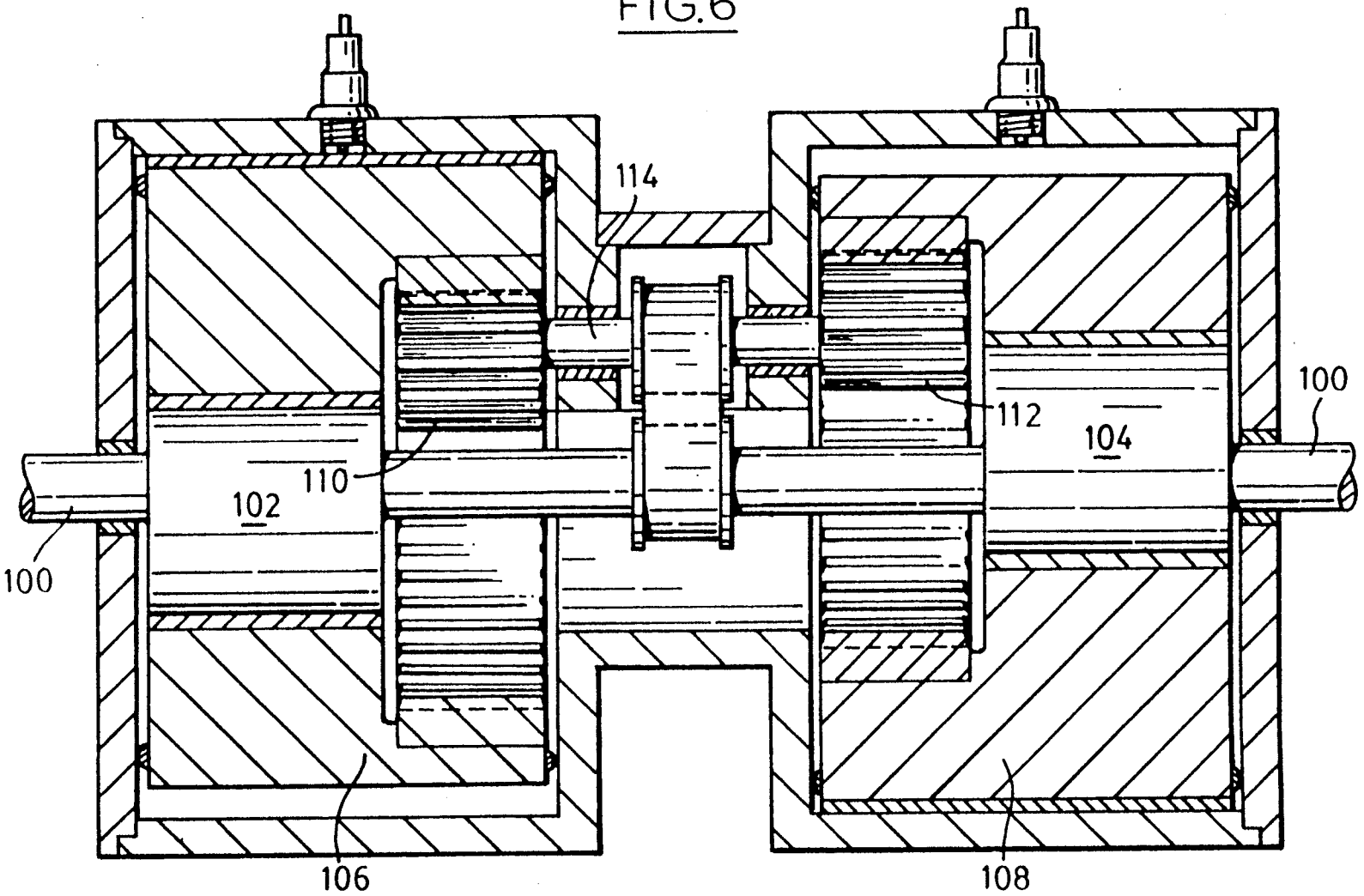
FIG. 6 is a view similar to FIG. 1 showing two engines coupled back-to-back on a common shaft.

FIG. 6 illustrates the combining of two rotary engines, as previously described, joined together to drive a common driven shaft 100. Two oppositely eccentric lobes 102, 104 are mounted on the shaft 100. Rotors 106, 108 are mounted on the lobes 102, 104 respectively so that when an apex of rotor 108 is at bottom dead-center, an apex of rotor 106 is at top dead-center. This will provide alternate combustion on the two rotors 106, 108 and maximum torque on the driven shaft 100 will occur every one-half revolution of the driven shaft 100 instead of every one revolution. Pinion gears 110, 112 are mounted on a common pinion shaft 114 so that their eccentricities are opposite to one another. More engines can be added to the same shaft to provide more power. This and other embodiments will become apparent to a person skilled in the art, the scope of the invention being defined in the following claims.

I claim:

1. A rotary engine comprising:

a housing having two opposing internal faces and a side wall joining said faces;

a driven shaft having an axis of rotation orthogonally extending substantially through the center of at least one of said opposing internal faces, the driven shaft having a lobe portion eccentric to said axis and located in the housing;

a rotor rotatably mounted on said lobe portion and having an internal ring gear substantially co-axial with said lobe portion;

a pinion gear meshing with the ring gear and eccentrically fixed on a pinion shaft, the pinion gear having the same eccentricity as said lobe portion, the pinion shaft extending orthogonally through one of said opposing internal faces of the housing and being rotatable therein; and drive means for transmitting torque between said pinion shaft and the driven shaft so that as the rotor is turned, the rotor substantially follows said side wall of the housing.

2. A rotary engine as claimed in claim 1 wherein the rotor has three apexes which follow said side wall of the housing as the rotor is turned.

3. A rotary engine as claimed in claim 2 wherein the ratio of the pinion gear to said ring gear is 1:3.

4. A rotary engine as claimed in claim 2 wherein said side wall is substantially epitrochoidal in shape.

5. A rotary engine as claimed in claim 1 wherein the drive means operates on a 1:1 ratio between said pinion shaft and the driven shaft.

6. A rotary engine as claimed in claim 5 wherein the drive means is a toothed belt or a chain drive system.

7. A rotary engine as claimed in claim 5 wherein the drive means is a gear train.

8. A rotary engine as claimed in claim 2 wherein the driven shaft is spaced from said pinion shaft by at least a length equal to a radius of the pinion gear less a radius of the driven shaft.

9. A rotary engine as claimed in claim 1 wherein there are chambers between the rotor and the housing which change in volume as the rotor is turned.

10. A rotary engine as claimed in claim 9 wherein fuel intake of a combustible fuel into one of said chambers begins when said one of said chambers is substantially at a minimum volume and continues until said one of said chambers is substantially at a maximum volume.

11. A rotary engine as claimed in claim 9 wherein combustion of a combustible fuel in one of said chambers occurs when said one of said chambers is substantially at a minimum volume.

12. A rotary engine as claimed in claim 9 wherein combustion occurs in a chamber when the distance from said pinion shaft to a meshing point of the pinion gear and said ring gear is substantially maximum.

13. A rotary engine as claimed in claim 9 wherein exhaust of a combusted combustible fuel from one of said chambers occurs from when said one of said chambers is substantially at a maximum volume to when said one of said chambers is substantially at a minimum volume.

14. A rotary engine as claimed in claim 9 wherein a maximum volume in a chamber is in the range of from about 30 cubic centimeters (1.8 cubic inches) to about 500 cubic centimeters (30 cubic inches).

15. A rotary engine as claimed in claim 14 wherein said maximum volume is substantially 50 cubic centimeters (3 cubic inches).

16. A rotary engine as claimed in claim 14 wherein said maximum volume is substantially 80 cubic centimeters (4.9 cubic inches).

17. A rotary engine as claimed in claim 9 wherein a ratio of maximum to minimum volume in a chamber is in a range of from about 3:1 to about 12:1.

18. A rotary engine as claimed in claim 17 wherein said ratio is substantially 6:1.

19. A rotary engine as claimed in claim 17 wherein cavities are cut in the rotor to produce said maximum to minimum chamber volume.

20. A rotary engine comprising:

a housing defining a cavity of substantially dual-lobed epitrochoidal shape;

a driven shaft having an axis of rotation orthogonally extending substantially through the center of the housing, the driven shaft having a lobe portion eccentric to said axis and located in the housing;

a rotor having three apexes substantially at 120 degrees to one another, the rotor rotatably mounted on said lobe portion and having a ring gear substantially coaxial with said lobe portion;

a pinion gear meshing with the ring gear and fixed eccentrically on a rotatable pinion shaft, the pinion shaft offset from the driven shaft, said eccentricity of the pinion gear substantially equal to said eccentricity of said lobe portion; and drive means coupled to said pinion shaft and the driven shaft for transmitting torque between the two so that as the rotor rotates, said apexes of the rotor trace said dual-lobed epitrochoidal shape.

* * * * *